US007677426B2

(12) United States Patent
Tillinghast et al.

(10) Patent No.: US 7,677,426 B2
(45) Date of Patent: Mar. 16, 2010

(54) FASTENER DRIVING DEVICE

(75) Inventors: Adam Tillinghast, South Kingstown, RI (US); Juan Ignacio Aguirre, East Greenwich, RI (US); Prudencio S. Canlas, Jr., North Kingstown, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 422 days.

(21) Appl. No.: 11/228,457

(22) Filed: Sep. 19, 2005

(65) Prior Publication Data

US 2007/0075113 A1 Apr. 5, 2007

(51) Int. Cl.
*B25C 1/04* (2006.01)

(52) U.S. Cl. ..... 227/130; 227/8; 227/10; 227/119; 227/120; 227/123

(58) Field of Classification Search ..... 227/8, 227/10, 130; 27/119, 120, 123
See application file for complete search history.

(56) References Cited

U.S. PATENT DOCUMENTS

| | | | | | |
|---|---|---|---|---|---|
| 3,086,207 | A | * | 4/1963 | Lingle et al. | 227/130 |
| 3,563,438 | A | | 2/1971 | Doyle | |
| 3,638,532 | A | | 2/1972 | Novak | |
| 4,041,598 | A | | 8/1977 | D'Angelo et al. | |
| RE29,527 | E | | 1/1978 | Ramspeck et al. | |
| 4,196,833 | A | * | 4/1980 | Haytayan | 227/8 |
| 4,253,598 | A | * | 3/1981 | Haytayan | 227/119 |
| 4,260,092 | A | | 4/1981 | Austin | |
| 4,339,065 | A | * | 7/1982 | Haytayan | 227/8 |
| 4,448,338 | A | * | 5/1984 | Graf et al. | 227/8 |
| 4,452,387 | A | * | 6/1984 | Haytayan | 227/8 |
| 4,509,668 | A | * | 4/1985 | Klaus et al. | 227/8 |
| 4,784,308 | A | * | 11/1988 | Novak et al. | 227/130 |
| 4,811,882 | A | | 3/1989 | Steeves et al. | |
| 5,020,712 | A | | 6/1991 | Monacelli | |
| 5,137,197 | A | | 8/1992 | Bauer | |

(Continued)

FOREIGN PATENT DOCUMENTS

| | | |
|---|---|---|
| DE | 39 04 504 | 3/1990 |

OTHER PUBLICATIONS

Partial European Search Report for application 06254728.6-2316, dated Jan. 16, 2007; 7 pages.

*Primary Examiner*—Rinaldi I. Rada
*Assistant Examiner*—Michelle Lopez
(74) *Attorney, Agent, or Firm*—Pillsbury Winthrop Shaw Pittman LLP

(57) ABSTRACT

A fastener driving device includes a nose assembly carried by a housing that has a reservoir. The nose assembly has a fastener drive track. At least a portion of the fastener drive track is defined by a movable portion of the nose assembly. A fastener driver is movably mounted in the housing and configured to enter the drive track and drive successive leading fasteners into a workpiece. A head valve is constructed and arranged to be actuated so as to allow the pressurized gas to move the fastener driver through an operating cycle. An actuator is constructed and arranged to actuate the head valve. The actuator includes a trigger valve constructed and arranged to allow passage of the pressurized gas from the reservoir to a chamber above the head valve, and a contact valve operatively connected to the movable portion of the nose assembly.

21 Claims, 11 Drawing Sheets

U.S. PATENT DOCUMENTS 5,193,730 A 3/1993 Tanaka et al.
5,238,167 A 8/1993 Howard et al.
5,452,835 A 9/1995 Shkolnikov
5,485,946 A * 1/1996 Jankel ..... 227/8
5,522,531 A 6/1996 Ogawa
5,551,621 A 9/1996 Vallee
5,562,240 A 10/1996 Campbell
5,579,975 A 12/1996 Moorman
5,662,257 A 9/1997 Mukoyama et al.
5,671,880 A * 9/1997 Ronconi ..... 227/130
5,692,663 A 12/1997 Yang
5,803,338 A 9/1998 Singer et al.
5,911,351 A * 6/1999 White ..... 227/130
6,006,975 A * 12/1999 Ishizawa ..... 227/119
6,205,894 B1 3/2001 Tanaka
6,394,332 B2 5/2002 Akiba
6,443,348 B2 9/2002 Lamb
6,471,106 B1 10/2002 Reining
6,641,018 B2 11/2003 Akiba
6,722,548 B2 4/2004 Odoni et al.
6,779,700 B2 * 8/2004 Bruins et al. ..... 227/136
6,820,788 B2 11/2004 Akiba
6,974,062 B2 12/2005 Akiba
2004/0238587 A1 12/2004 Favre-Bulle
2005/0001007 A1 1/2005 Butzen

* cited by examiner

FASTENER DRIVING DEVICE

BACKGROUND OF THE INVENTION

1. Field of the Invention

The present invention generally relates to fastener driving devices, and more specifically relates to fastener driving devices that drive fasteners for connecting metal connectors to a workpiece.

2. Description of Related Art

The construction industry has seen an increase in the use of metal connectors when joining two workpieces together. For example, joist hangers are commonly used in the construction of floors in buildings, as well as outdoor decks. Also, L-shaped metal connectors are used to connect and/or reinforce two workpieces that are joined perpendicularly, such as when connecting the framing of two walls. Conventional fastener driving devices, such as pneumatic nailers, have been difficult to use in metal connector applications because of the size of such devices. For example, a conventional pneumatic nailer used for framing applications is designed to drive nails that are 2-4 inches in length and have diameters of about 0.113-0.162 inches. However, fasteners that are used to attach metal connectors to workpieces are typically about 1.5-2.5 inches in length and have diameters of about 0.131-0.162 inches. While framing nailers may be used to drive longer metal connector fasteners, they are typically not configured to drive shorter metal connector fasteners that are 1.5 inches in length. There are currently no single shot pneumatic nailers available that are dedicated to only driving a metal connector fastener that has a length of about 1.5 inches.

Moreover, the design of conventional pneumatic nailers makes it difficult to accurately locate a fastener into the hole of the metal connector due to design of the nose and the contact arm. A conventional contact arm is biased to extend past the nose of the nailer so that when the contact arm is pressed against the workpiece, the contact arm cooperates with the trigger to cause the nailer to actuate and drive the fastener into the workpiece. In many applications, such as framing and finishing, the fastener may be located in a range of locations, i.e. the precise location of the fastener may not be important. Conversely, when driving a fastener through a hole of a metal connector, the precision of the drive is important because of the risk of damaging the nailer or the metal connector. Although there have been attempts to use the tip of the fastener that is about to be driven as the hole locator, providing a robust and relatively inexpensive contact arm has been challenging.

BRIEF SUMMARY OF THE INVENTION

Therefore, it is an aspect of the present invention to provide a fastener driving device that allows the tip of a fastener to be used to locate a hole in a metal connector and has the safety features of a conventional fastener driving device.

In an embodiment, a fastener driving device is provided. The fastener driving device includes a housing that has a reservoir therein. The reservoir is configured to receive a pressurized gas. The device also includes a nose assembly that is carried by the housing. The nose assembly has a fastener drive track. At least a portion of the fastener drive track is defined by a movable portion of the nose assembly. The device also includes a magazine assembly that is constructed and arranged to feed successive leading fasteners from a supply of fasteners contained therein into the drive track, and a fastener driver that is movably mounted in the housing and configured to enter the drive track and drive the successive leading fasteners, one at a time, into a workpiece. The device further includes a head valve constructed and arranged to be actuated so as to allow the pressurized gas to move the fastener driver through an operating cycle. The cycle includes a drive stroke in which the leading fastener is driven into the workpiece, and a return stroke. An actuator is constructed and arranged to actuate the head valve. The actuator includes a trigger valve that is constructed and arranged to allow passage of the pressurized gas from the reservoir to a chamber above the head valve, and a contact valve that is operatively connected to the movable portion of the nose assembly. When the trigger valve is actuated, the pressurized gas flows through the trigger valve to the contact valve. The contact valve is constructed and arranged to 1) contain the pressurized gas if the pressurized gas can effect movement of the movable portion of the nose assembly beyond a predetermined distance, and 2) exhaust the pressurized gas from the chamber above the head valve to atmosphere if the pressurized gas cannot effect movement of the movable portion of the nose assembly beyond the predetermined distance, thereby causing actuation of the head valve.

It is another aspect of the present invention to provide a dedicated fastener driving device for driving only fasteners with a length of about 1.5 inches with a single blow. In an embodiment of the invention, a fastener driving device is provided. The fastener driving device has a housing that defines a reservoir therein. The reservoir is configured to receive a pressurized gas. The device also includes a nose assembly that is carried by the housing. The nose assembly has a fastener drive track. A magazine assembly is constructed and arranged to feed only one length of successive leading fasteners from a supply of fasteners contained therein into the drive track. A fastener driver is movably mounted in the housing and is configured to enter the drive track and drive the successive leading fasteners, into a workpiece. A head valve is constructed and arranged to be actuated so as to allow the pressurized gas to move the fastener driver through successive operating cycles. Each cycle includes a drive stroke in which the leading fastener is driven into the workpiece, and a return stroke. An actuator is constructed and arranged to actuate the head valve. The fasteners have a length of about 1.5 inches and are configured to attach a metal connector to the workpiece. The magazine is configured to position the leading fastener in the drive track such that a tip of the leading fastener extends outward and away from the nose assembly before the leading fastener is driven by the fastener driver.

It is another aspect of the present invention to provide an actuator for a fastener driving device. The actuator includes a trigger valve, and a contact valve. The trigger valve is configured to 1) communicate a pressurized gas from a reservoir associated with the fastener driving device with a chamber above a head valve disposed within the fastener driving device, and 2) communicate the pressurized gas from the chamber to the contact valve. The contact valve is configured to 1) contain the pressurized gas from the chamber if the fastener driving device is not located within a predetermined distance of a workpiece, and 2) communicate the pressurized gas from the chamber to atmosphere if the fastener driving device is located within the predetermined distance, thereby actuating the fastener driving device.

It is another aspect to provide a nose assembly for a fastener driving device. The nose assembly defines a drive track and includes a fixed portion the defines a first portion of the drive track, and a movable portion that is movable with respect to the fixed portion, and defines a second portion of the drive track. The movable portion has a lateral opening for receiving fasteners from a magazine. The movable portion has an inner surface thereof for providing a guide surface that is configured to guide a fastener being driven through the drive track. The movable portion is normally in a retracted position and is moved to an extended position beyond the fixed portion during a fastening operation.

It is another aspect to provide a pneumatic valve for controlling whether a fastener driving device will drive a fastener into a workpiece. The pneumatic valve communicates with a detector and a trigger valve of the device. When the trigger valve is actuated and the detector detects that a nose of the device is positioned proximate to the workpiece, the pneumatic valve causes the device to drive the fastener.

These and other aspects, features, and advantages of the invention will become apparent from the following detailed description when taken in conjunction with the accompanying drawings, which are part of this disclosure and which illustrate, by way of example, the principles of this invention.

BRIEF DESCRIPTION OF THE DRAWINGS

Features of the invention are shown in the drawings, in which like reference numerals designate like elements. The drawings form part of this original disclosure, in which.

DETAILED DESCRIPTION OF THE INVENTION

Figure 1:
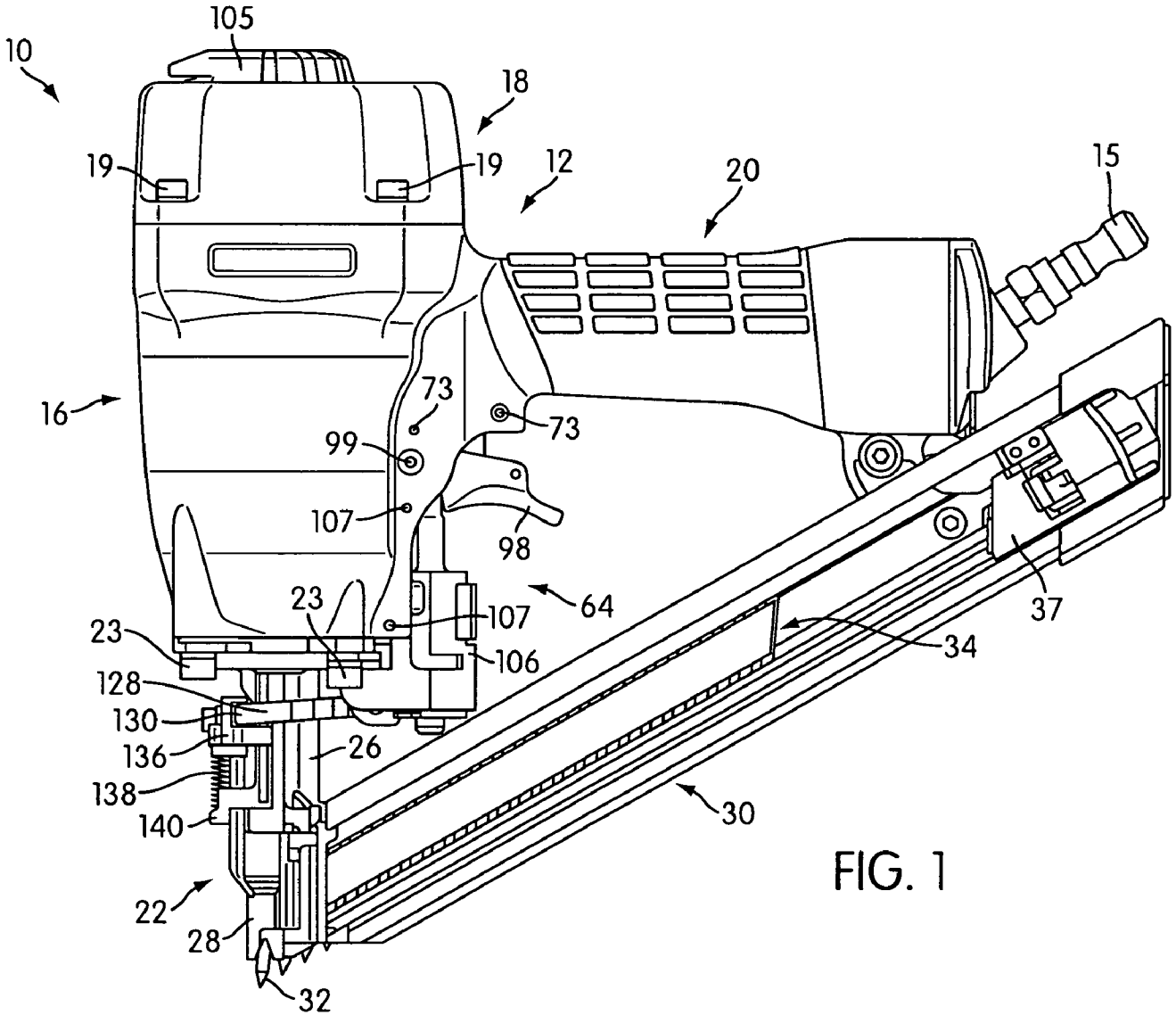
FIG. 1 is a side view of a fastener driving device according to an embodiment of the present invention.

FIG. 1 illustrates a fastener driving device 10 according to an embodiment of the present invention. The device 10 includes a housing 12 that defines a reservoir 14 (see FIG. 2) therein. The housing 12 is preferably constructed from a lightweight yet durable material, such as magnesium. The reservoir 14 is configured to receive a pressurized gas that is used to power the device 10. In an embodiment, the pressurized gas may be provided to the reservoir 14 from a compressor through a hose. The hose may be connected to the device 10 via a fitting 15 that may be attached to the housing 12, or the pressurized gas may be provided to the reservoir 14 through a cartridge. For example, the pressurized gas may be air that has been compressed by a compressor, as is commonly used in pneumatic tools. It is also contemplated that any gas that releases energy upon expansion, such as a gas produced as a by-product of combustion, or a gas that is produced upon a phase transformation of a liquid, such as carbon dioxide may also be used to power the device 10. The illustrated embodiment is not intended to be limiting in any way.

Figure 2:
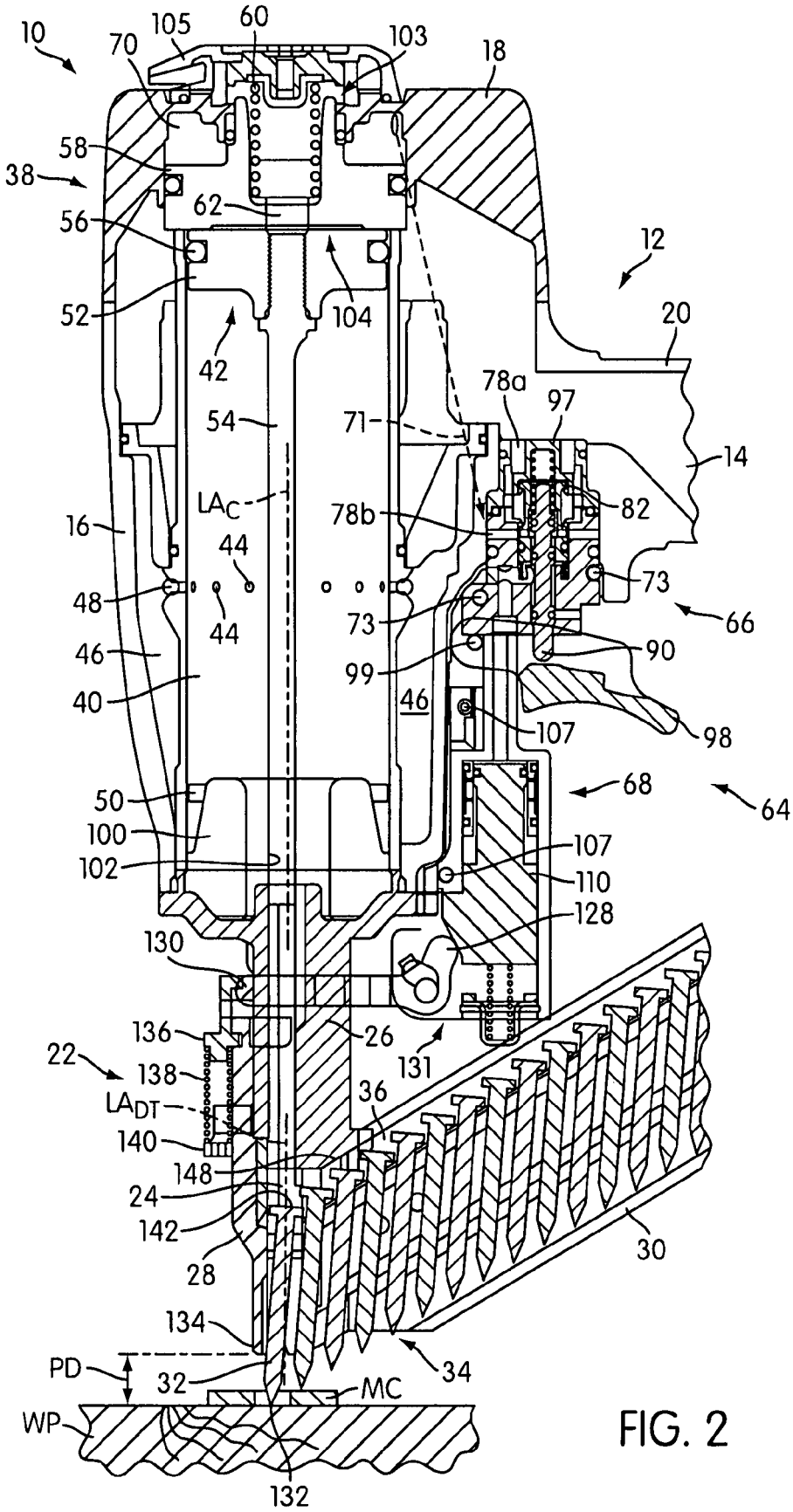
FIG. 2 is a partial cross-sectional view of the fastener driving device of FIG. 1, with a pressurized gas contained within the device.

As illustrated, the housing 12 includes an engine receiving portion 16 and a cap 18 that is connected to the engine receiving portion 16 at one end with a plurality of fasteners 19. The housing 12 also includes a handle 20 that extends from the engine receiving portion 16. As shown, the handle 20 may extend substantially perpendicularly from the engine receiving portion 16. The handle 20 is configured to be received by a user's hand, thereby making the device 10 portable. The reservoir 14 is preferably substantially defined by the handle 20, although it is contemplated that a portion of the reservoir 14 may be defined by the engine receiving portion 16 as well, as shown in FIG. 2.

The device 10 also includes a nose assembly 22 that is connected to the housing 12 with a plurality of fasteners 23. The nose assembly 22 defines a fastener drive track 24 therein. The nose assembly 22 includes a fixed portion 26 that is connected to the housing 12, and a movable portion 28 that is movably connected to the fixed portion 26. At least a portion of the fastener drive track 24 is defined by the movable portion 28. The movable portion 28 is movable in a direction substantially parallel to the drive track 24, and will be discussed in further detail below.

A magazine assembly 30 is constructed and arranged to feed successive leading fasteners 32 from a supply of fasteners 34 contained therein along a feed track 36 and into the drive track 24. The supply of fasteners 34 is urged toward the drive track 24 with a pusher 37 that is biased towards the drive track 34 and engages the last fastener in the supply of fasteners 34. The magazine assembly 30 is preferably constructed and arranged to only supply fasteners 34 having a length of about 1.5 inches and that are specifically designed for connecting a metal connector MC with a workpiece WP (see FIG. 6). That is, the shank diameter of each fastener is sized to pass through a hole in the metal connector MC, and the head of the fastener is sized to prevent the fastener from passing entirely through the hole so that the metal connector MC may be fixedly secured to the workpiece WP.

The arrangement of the magazine assembly 30 illustrated in FIG. 1 allows for a compact and lightweight device 10. One end of the magazine assembly 30 is preferably connected to the fixed portion 26 of the nose assembly 22 by known methods. As shown in FIG. 1, the magazine assembly 30 may also be connected to the handle 20. In the illustrated embodiment, the magazine assembly 30 is connected to the handle 20 at a location in between its ends, although it is contemplated that the magazine assembly 30 may be connected to the handle 20 at an end that is distal to the nose assembly 22. Although the illustrated magazine assembly 30 is configured to receive fasteners that are collated in a stick configuration, it is also contemplated that a magazine assembly that is configured to accommodate fasteners that are collated in a coil may also be used. The illustrated embodiment is not intended to be limiting in any way.

As shown in FIG. 2, an engine 38 is disposed in the engine receiving portion 16 of the housing 12. The engine 38 includes a cylinder 40 and a fastener driver 42 that is movably mounted in the cylinder 40, and, hence, the housing 12. The cylinder 40 is oriented such that its longitudinal axis $LA_C$ substantially aligns with a longitudinal axis $LA_{DT}$ of the drive track 24, as shown in the Figures. The cylinder 40 includes a plurality of holes 44 that are arranged circumferentially around the cylinder 40 at an intermediate portion thereof. The holes 44 allow gas that is in the cylinder 40 to flow into a plenum 46 that is defined by an outside surface of the cylinder 40 and the housing 12. The holes 44 are provided with seals 48 that act as one-way valves such that gas may exit the cylinder 40 into the plenum 46, but gas in the plenum 46 may not enter the cylinder 40 through the holes 44. Instead, gas may enter the cylinder 40 through at least one opening 50 that is located towards one end of the cylinder 40 near the drive track 24, as shown in FIG. 2. Movement of gas in and out of the cylinder 40 will be discussed in greater detail below in connection with the operation of the device 10.

The fastener driver 42 is configured to enter the drive track 24 and drive the successive leading fasteners 32, one at a time, into the workpiece WP. The fastener driver 42 may have any configuration, but preferably includes a piston 52 and a drive rod 54 that is connected to the piston 52. A seal 56 is provided between the piston 52 and an interior wall of the cylinder 40 so as to form a slidable seal. This allows pressure on one side of the piston 52 to be different from pressure on the other side of the piston 52 so that a pressure differential may effect movement of the piston 52. The drive rod 54 may be connected to the piston 52 by any suitable fastening technique, such as a threaded or a welded connection. The illustrated embodiment is not intended to be limiting in any way. The drive rod 54 may have a substantially circular cross-section, or the drive rod 54 may have a cross-section that is D-shaped, or is shaped as a crescent, as would be understood by one of ordinary skill in the art.

Figure 6:
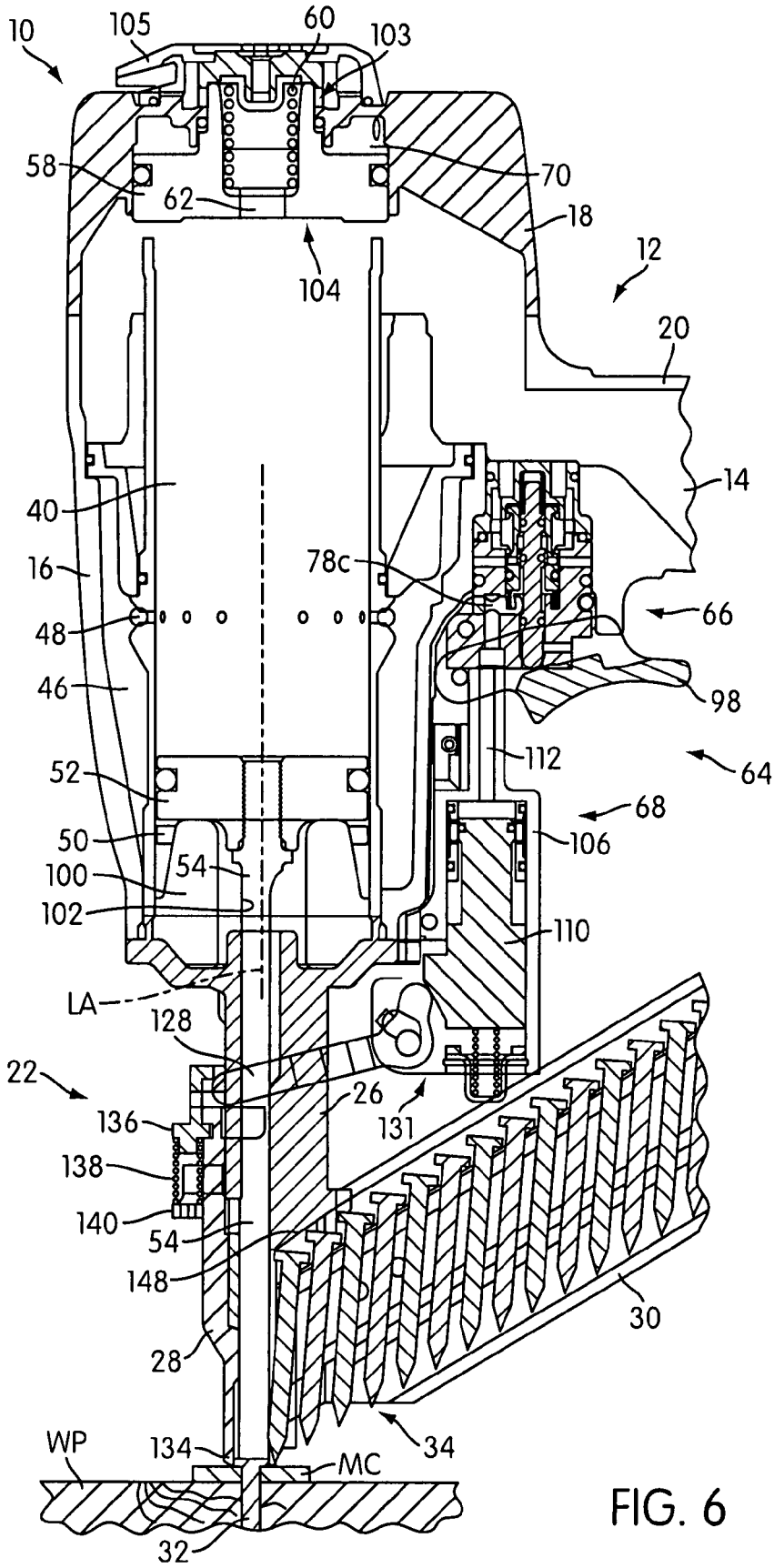
FIG. 6 is a partial cross-sectional view of the fastener driving device of FIG. 2 with the actuator actuated and a workpiece located within the predetermined distance.

The engine 38 also includes a head valve 58 that is disposed above the cylinder 40. The head valve 58 is constructed and arranged to substantially seal the top of the cylinder 40 from the reservoir 14 when the head valve 58 is in a closed position, as shown in FIG. 2, and move away from the cylinder 40 when the head valve 58 is moved to an open position, as shown in FIG. 6. A spring 60 is disposed between the head valve 58 and the cap 18 such that the head valve 58 is biased to the closed position when there is no pressurized gas in the device 10 or when the pressurized gas applies equal force on both sides of the head valve 58. The head valve 58 includes an opening 62 that allows gas on the side of the head valve 58 that faces the cylinder 40 to exhaust to atmosphere, as will be discussed in greater detail below. The head valve 58 is constructed and arranged to be actuated so as to allow the pressurized gas that is in the reservoir 14 to enter the cylinder 40 and move the fastener driver 42 through an operating cycle. Each cycle includes a drive stroke in which the driver 42 drives the leading fastener 32 into the workpiece WP, and a return stroke in which the driver 42 is returned to its initial position so that it is ready for another drive stroke.

The device 10 also includes an actuator 64 that is constructed and arranged to actuate the head valve 58, and, hence, initiate the drive stroke. While most conventional actuators include a trigger valve and a contact arm that interacts with the trigger valve through mechanical linkages, the actuator 64 of the device 10 of the present invention generally includes a trigger valve 66 and a pneumatic contact valve 68. The trigger valve 66 is constructed and arranged to allow passage of the pressurized gas from the reservoir 14 to a chamber 70 above the head valve 58 through a passageway 71 (see FIG. 4), and to selectively allow passage of gas from the chamber 70 to the contact valve 68. The contact valve 68 is operatively connected to the movable portion 28 of the nose assembly 22, and also selectively allows gas that enters the contact valve 68 via the trigger valve 66 to exhaust to atmosphere, as will be explained in further detail below.

Figure 3:
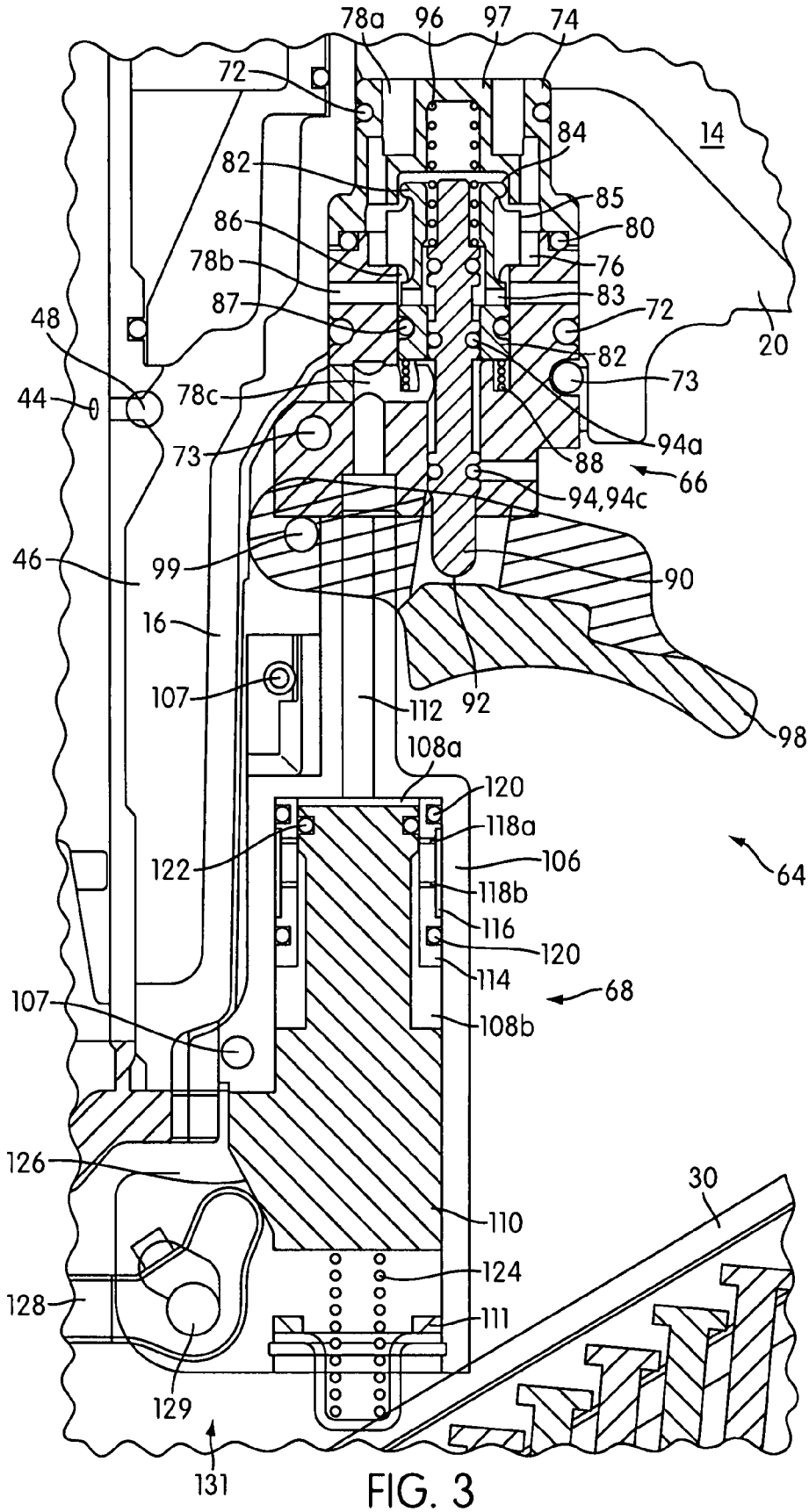
FIG. 3 is a more detailed view of an actuator of the fastener driving device of FIG. 2.

The trigger valve 66 is shown in greater detail in FIG. 3. As shown, the trigger valve 66 may be inserted into a section of the housing 12, preferably in the handle 20 near the intersection of the handle 20 and the engine receiving portion 16. At least one seal 72 is provided on the outside of the trigger valve 66 to ensure that the pressurized gas in the reservoir 14 cannot escape to atmosphere through any gaps between the trigger valve 66 and the housing 12. The trigger valve 66 may be secured to the housing 12 with pins 73, or by any other conventional method.

The trigger valve 66 includes a body 74 that defines a cavity 76 therein, and a plurality of passageways 78*a*, 78*b*, 78*c* that are connected to the cavity 76. A first passageway 78*a* is connected to the reservoir 14, a second passageway 78*b* is connected to the chamber 70 above the head valve 58 via the passageway 71, and a third passageway 78*c* is connected to the contact valve 68. Thus, the pressurized gas in the reservoir 14 flows to the chamber 70 above the head valve 58 via the trigger valve 66 through the first and second passageways 78*a*, 78*b*. As illustrated, the body 74 may include more than one portion to make assembly of the trigger valve 66 easier. A seal 80 is provided between the portions of the body 74 so that pressurized gas that is within the body 74, e.g. in the passageways 78 and/or cavity 76, cannot escape out of the body 74 at the interface of the two portions.

Figure 9:
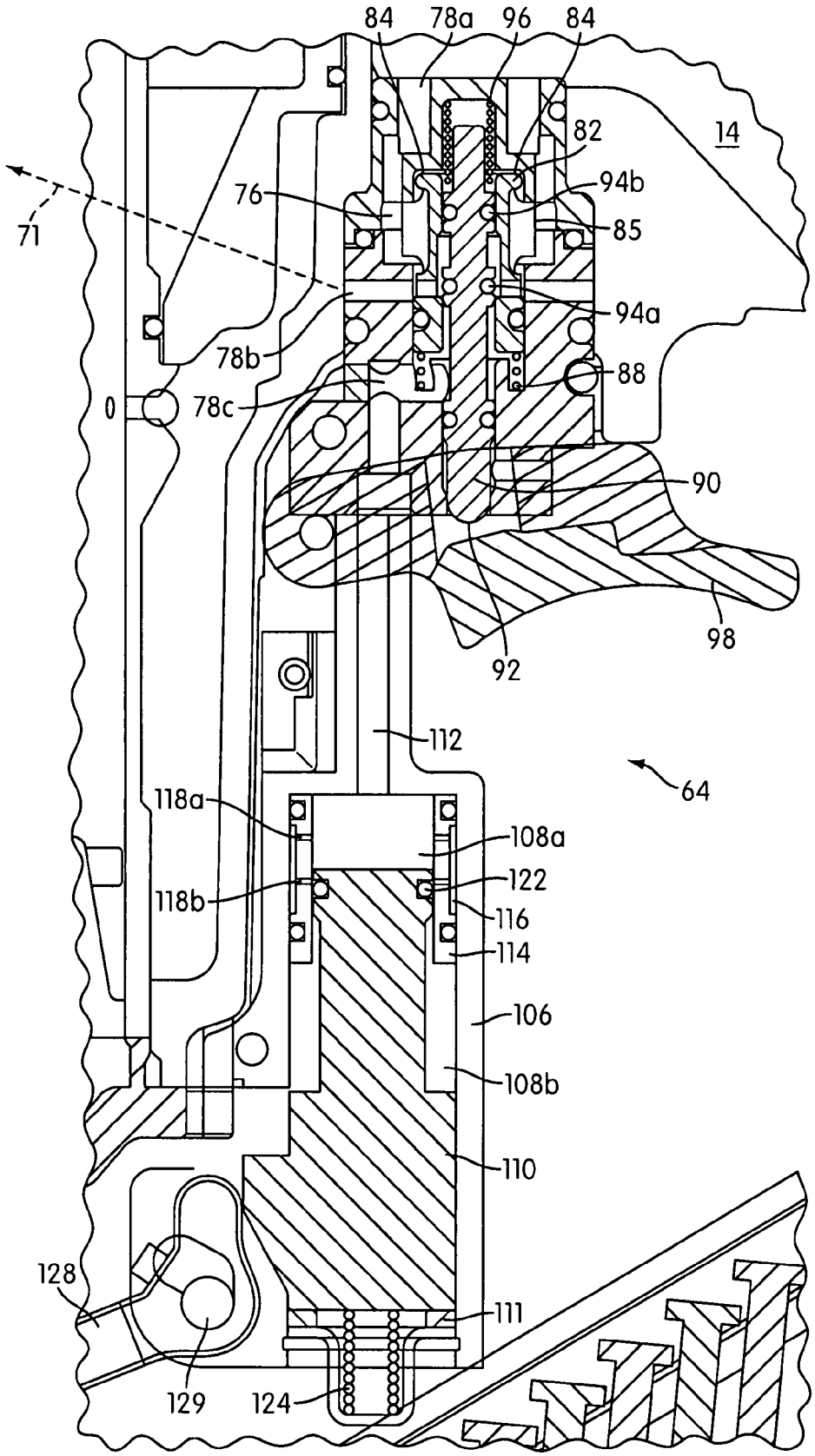
FIG. 9 is a detailed view of the actuator after the pressurized gas has been received by the device while a valve stem of a trigger valve is depressed.

The trigger valve 66 also includes a poppet 82 that is slidably received by the body 74 in the cavity 76. The poppet 82 is constructed and arranged to move between a first position that seals one portion 84 of the cavity 76 from the reservoir 14, as shown in FIG. 9, and a second position that seals another portion 86 of the cavity 76 from the reservoir 14, as shown in FIG. 3. The poppet 82 is biased to the first position with a spring 88 that is disposed within the cavity 76 of the body 74. As illustrated, the poppet 82 is substantially cylindrical in shape and includes at least one passageway 83 that allows gas to flow from an interior space within the poppet 82 to an exterior of the poppet 82. A seal 85 substantially surrounds an upper portion of the poppet 82 and provides the seal between the poppet 82 and the body 74. A second seal 87, preferably in to form of an o-ring, substantially surrounds a lower portion of the poppet 82 and also provides a seal between the poppet 82 and the body 74.

Figure 5:
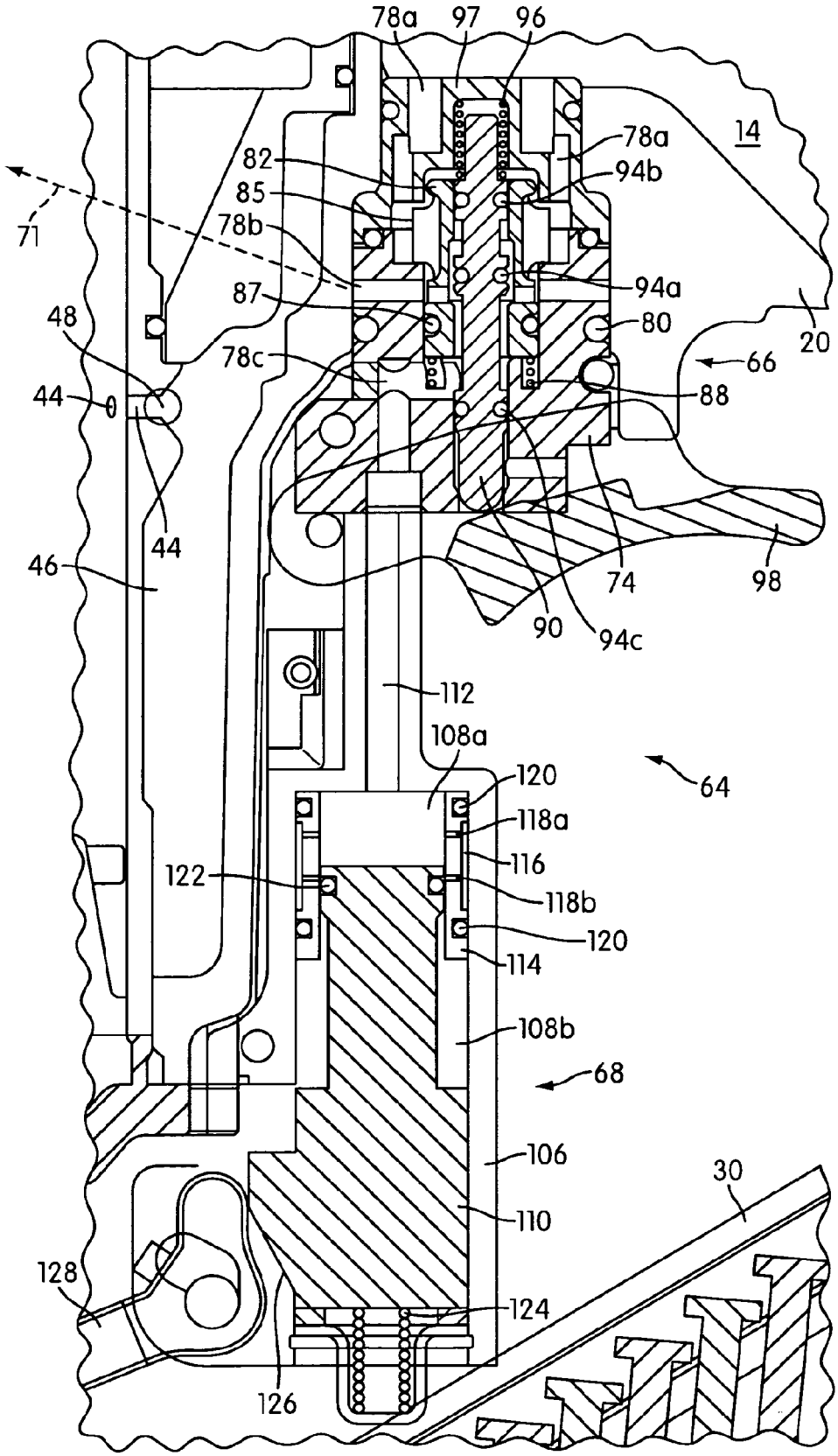
FIG. 5 is a more detailed view of the actuator of the device of FIG. 4.

A valve stem 90 is slidably received by the poppet 82 and the body 74, and cooperates with the poppet 82 to selectively seal and/or open different portions of the trigger valve 66. One end 92 of the valve stem 90 preferably extends outwardly from the body 74 so that it may be easily accessed by the user. The valve stem 90 is configured to move between a rest position, as shown in FIG. 3, and an actuated position, as shown in FIG. 5. A plurality of seals 94*a*, 94*b*, 94*c*, preferably in the form of o-rings, are provided on the valve stem 90 to seal the valve stem 90 and the body 74 or the poppet 82, depending on the location of the seal, as will be discussed below.

The trigger valve 66 may be moved to the actuated position by pressing the valve stem 90 against the force applied on the valve stem 90 by the pressurized gas, and the bias of a spring 96 that is disposed between the valve stem 90 and an end cap portion 97 of the body 74. This may be done with the user's finger, but is preferably done with a trigger 98 that is rotatably mounted to the housing 12 with a pin 99. Of course, triggers that have linear movement rather then rotational movement are also contemplated. When the trigger 98 is rotated toward the valve stem 90, it engages the valve stem 90 and presses the valve stem 90 against the bias of the spring 96. When the trigger valve 66 is actuated, i.e. when the valve stem 90 is moved against the bias of the spring 96 and the pressurized gas, the passageway 78*c* within the trigger valve 66 between the chamber 70 above the head valve 58 and the contact valve 68 is opened, and the pressurized gas in the chamber 70 is now able to flow to the contact valve 68. At the same time, the passageway 78*a* to the reservoir 14 is cut off from the passageways 78*b*, 78*c* to the chamber 70 above the head valve 58 and the contact valve 68, respectively. Of course, the passageway 78*a* to the reservoir 14 does not have to be cut off from the passageways 78*b*, 78*c* at the same time as the passageway 78*c* is opened. It is contemplated that the aforementioned opening and closing of the passageways 78*a*, 78*b*, 78*c* may be a sequential operation as the valve stem 90 is depressed.

Specifically, movement of the valve stem 90 moves the seals 94*a*, 94*b*, 94*c* that surround the valve stem 90, thereby closing off certain paths of gas flow. For example, as shown in FIG. 3, when the valve stem 90 is in its rest position, a first seal 94*a* seals the third passageway 78*c* from the pressurized gas by creating a seal between the valve stem 90 and the poppet 82, while the seal 87 creates a seal between the poppet 82 and the body 74. As shown in FIG. 5, when the valve stem 90 is pressed against the bias of the spring 96 and pressurized gas, a second seal 94*b* seals the reservoir 14 from the second passageway 78*b* to the chamber 70 above the head valve 58 and the third passage 78*c* to the contact valve 68 by creating a seal between another portion of the valve stem 90 and the poppet 82. At the same time, the poppet 82 is also in a position that seals the reservoir 14 from the second and third passageways 78*b*, 78*c*. The third seal 94*c* that surrounds the valve stem 90 prevents pressurized gas from escaping the trigger valve 66 through any gap between the valve stem 90 and the body 74, as shown in FIG. 5.

Actuation of the head valve 58, or movement of the head valve 58 to the open position, will depend on whether the pressurized gas from the chamber 70 above the head valve 58 is exhausted to atmosphere. Once the pressurized gas from the chamber 70 starts to be exhausted, the pressure within the chamber 70 drops. This pressure drop, when high enough, allows the head valve 58 to move to the open position due to the force being exerted on the head valve 58 by the pressurized gas within the reservoir 14, which is at a greater pressure. In general, whether the pressurized gas is exhausted to the atmosphere will depend on the location of the movable portion 28 of the nose assembly 22, and whether the lead fastener 32 is in contact with the workpiece WP, as will be discussed in further detail below.

The contact valve 68 is constructed and arranged to 1) contain the pressurized gas from the chamber 70 above the head valve 58 if the pressurized gas can effect movement of the movable portion 28 of the nose assembly 22 beyond a predetermined distance PD, and 2) exhaust the pressurized gas from the chamber 70 above the head valve 58 to atmosphere if the pressurized gas cannot effect movement of the movable portion 28 of the nose assembly 22 beyond the predetermined distance PD, thereby causing actuation of the head valve 58, as will be discussed in greater detail below.

The contact valve 68 includes a contact valve housing 106 that defines a cavity, designated by 108*a* and 108*b*, and a body portion 110 that is movable within the cavity 108*a*, 108*b*. The contact valve housing 106 may be connected to the housing 12 with pins 107 or may be integrally formed with the housing 12. As shown in FIG. 3, the contact valve housing 106 defines a passageway 112 that extends from the trigger valve 66 to a first portion 108*a* of the cavity 108*a*, 108*b*. The contact valve housing 106 may be a single structure, or may include two or more structures that are connected together to facilitate the assembly of the contact valve 68.

An insert 114 is disposed within the cavity 108*a*, 108*b* and is constructed and arranged to allow gas to enter a volume 116 that is defined by the insert 114 and the contact valve housing 106. A plurality of spaced apart openings 118*a*, 118*b* are connected to the volume 116 to allow gas to flow into the volume 116, and out of the volume 116 if the body portion 110 is positioned to allow such flow through the volume 116, as will be discussed in greater detail below. Of course, only the cross section of the contact valve 68 is shown. It should be appreciated that the volume 116 may peripherally surround the insert 114, or the insert 114 may be configured to create a plurality of smaller volumes that are disposed around the insert 114. Likewise, the openings 118*a*, 118*b* may be substantially circular holes that are located at various points circumferential to the insert 114, or may be slots, or may be any other shape. The illustrated embodiment is not intended to be limiting in any way. As shown, the insert 114 includes a pair of seals 120 that surround the insert 114 so that any pressurized gas that enters the volume 116 will not escape to the cavity 108*a*, 108*b* on the outside of the insert 114. The insert 114 may be fixedly attached to the contact valve housing 106 by conventional methods, such as welding or pins, or the seals 120 may be sized to create a pressure fit so that the insert 114 is essentially fixedly attached to the contact valve housing 106.

One portion of the body portion 110 is constructed and arranged to be slidably movable within the insert 114. A seal 122 surrounds the body portion 110 such that gas may not pass from the first portion of the cavity 108*a* to a second portion of the cavity 108*b* in between the insert 114 and the body portion 110 at the location of the seal 122. The body portion 110 is preferably biased in the first position by a spring 124 that is located between one end of the body portion 110 that is opposite the seal 122 and the contact valve housing 106, as shown in FIG. 3 A cam surface 126 is provided near the end of the body portion 110 that is in contact with the spring 124. The cam surface 126 is preferably an inclined surface, as shown in FIG. 3. The angle of the incline may be set so that a mechanical advantage may be provided. However, it is contemplated that other shapes may be used when providing the cam surface 126. The illustrated embodiment is not intended to be limiting in any way.

Figure 4:
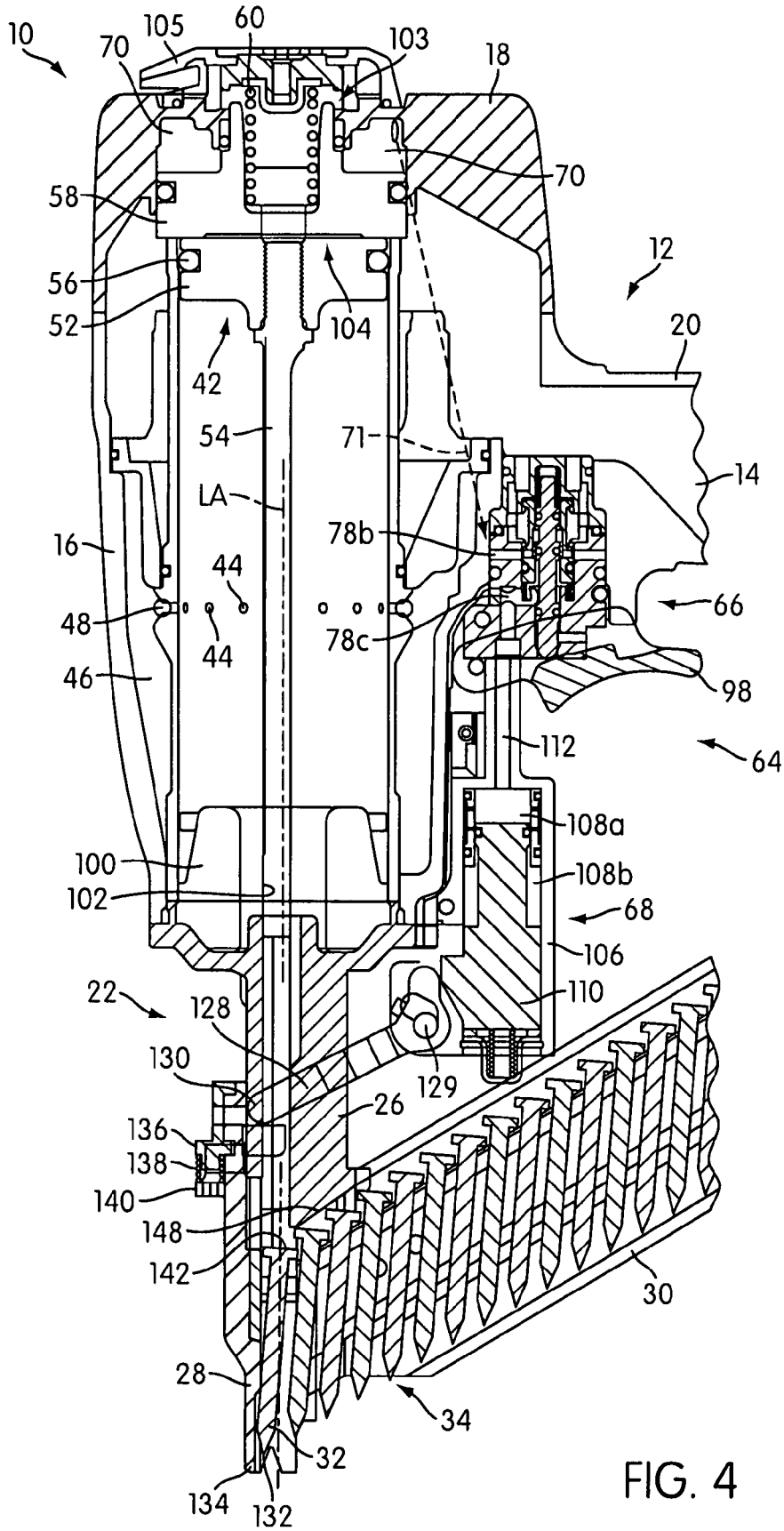
FIG. 4 is a partial cross-section view of the fastener driving device of FIG. 2, with the actuator actuated and no workpiece located within a predetermined distance of a nose assembly of the device.

The cam surface 126 interacts with a cam follower 128 that is rotatably mounted to the contact valve housing 106 at one end with a pin 129 that provides an axis of rotation, and extends towards the nose assembly 22. As shown in FIGS. 2 and 4, a distal end 130 of the cam follower 128 is configured to interact with the movable portion 28 of the nose assembly 22 such that as the cam follower 128 rotates, the distal end 130 of the cam follower 128 causes the moveable portion 28 of the nose assembly 22 to move relative to the fixed portion 26 of the nose assembly 22.

Figure 10:
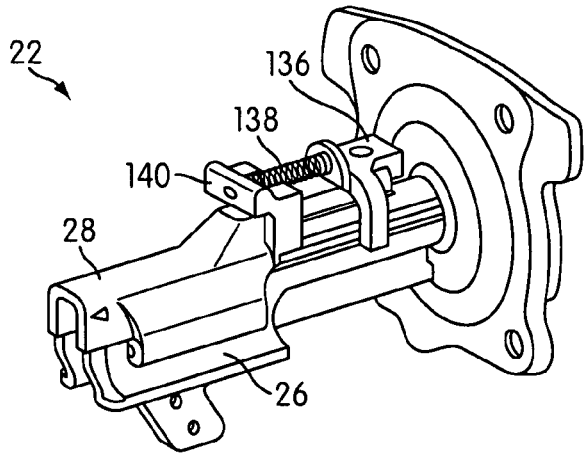
FIG. 10 is a perspective view of an embodiment of a nose assembly of the device of FIG. 1.
Figure 11:
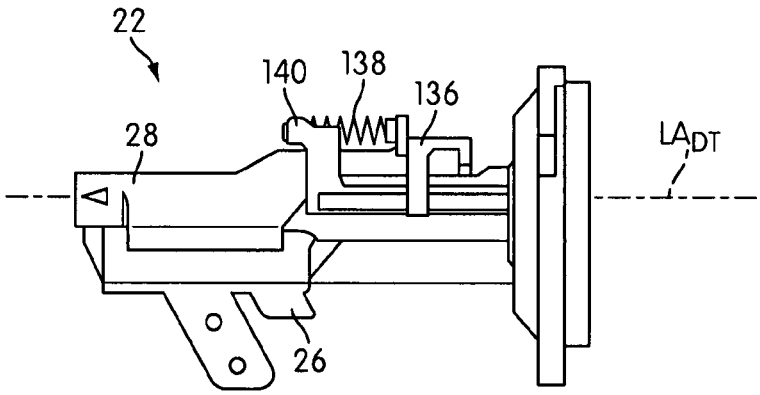
FIG. 11 is a side view of the nose assembly of FIG. 10 at rest, with a movable portion of the nose assembly in a retracted position.
Figure 12:
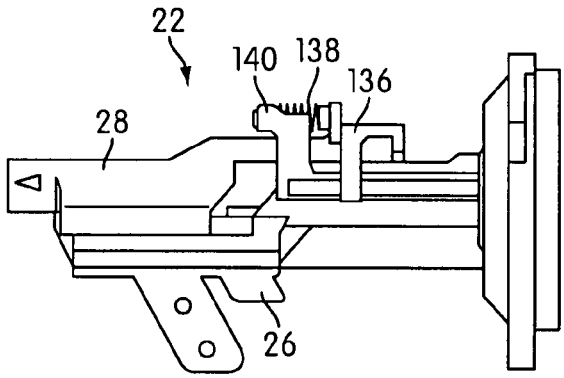
FIG. 12 is a side view of the nose assembly of FIG. 11 with the movable portion of the nose assembly in an extended position.

As shown in FIGS. 10-12, the movable portion 28 of the nose assembly 22 is connected to a slider 136 that is constructed and arranged to move substantially linearly along the fixed portion 26 of the nose assembly 22 in a direction that is substantially parallel to the longitudinal axis LA. A spring 138 is disposed between the slider 136 and a spring receiving portion 140 of the fixed portion 26 to provide a light bias on the slider 136, and hence the movable portion 28, so that the movable portion 28 is biased in a retracted position. As shown in FIGS. 2 and 4, the cam follower 128 interacts with the slider 136 such that as the cam follower 128 rotates due to movement of the body portion 110 of the contact valve 68, the distal end 130 of the cam follower 128 pushes the slider 136 against the bias of the spring 138 so that the movable portion 28 moves towards an extended position if there is nothing blocking such movement.

If the movable portion 28 of the nose assembly 22 is allowed to move, i.e. there is nothing in front of the movable portion 28 of the nose assembly 22, when the pressurized gas causes the body portion 110 of the contact valve 68 to move against the bias of the spring 124, the cam follower 128 is able to rotate, thereby displacing the movable portion 28 of the nose assembly 22 outwardly and away from the housing 12, as shown in FIG. 4. Because there is nothing to stop the movement of the movable portion 28 of the nose assembly 22, the body portion 110 of the contact valve 68 will continue to move under the influence of the pressurized gas until it abuts a stop 111 that is disposed within the contact valve housing 106. However, if the movable portion 28 of the nose assembly 22 is prevented from moving away from the housing 12, the cam follower 128 essentially acts as a brake and will not allow the body portion 110 to move within the cavity 108*a*, 108*b*.

Figure 7:
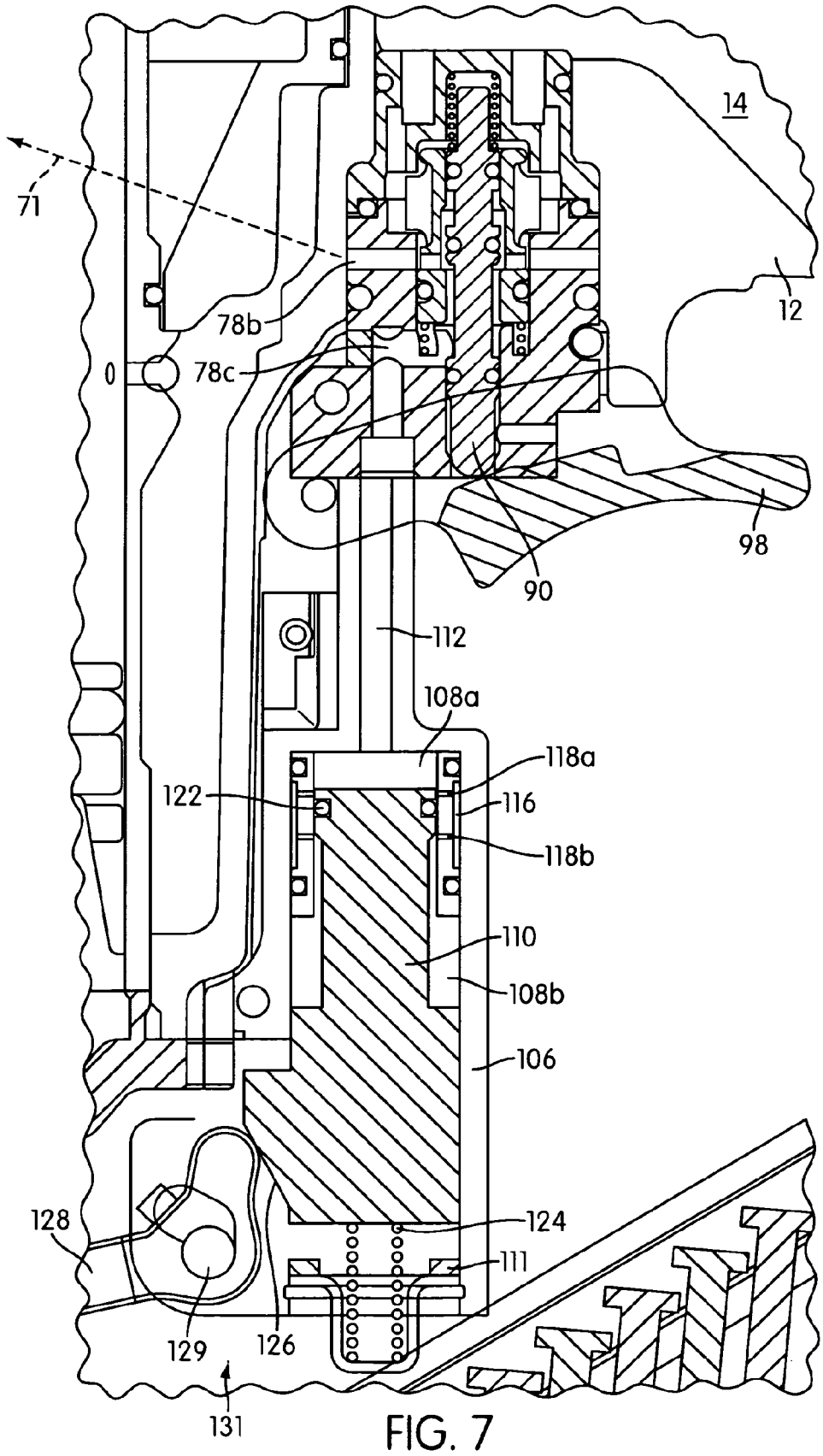
FIG. 7 is a more detailed view of the actuator of the device of FIG. 6.

The openings 118*a*, 118*b* in the insert 114 of the contact valve 68 are spaced such that when the movable portion 28 of the nose assembly 22 moves relative to the fixed portion 26 of the nose assembly 22 up to and including the predetermined distance PD, the seal 122 on the body portion 110 passes by the first openings 118*a*, but not the second openings 118*b*. This allows the pressurized gas that has passed from the chamber 70 above the head valve 58 and through the trigger valve 66 to flow through the passageway 112, into the first portion of the cavity 108*a*, into the first openings 118*a*, and into the volume 116 between the insert 114 and the contact valve housing 106. If the body portion 110 does not travel further than the predetermined distance PD, the pressurized gas may also flow through the second openings 118*b* and into the second portion of the cavity 108*b* at a position below the seal 122. The pressurized gas may then escape to atmosphere through an opening 131 in the contact valve housing 106, as shown in FIGS. 6 and 7, as there is no other seal to prevent the pressurized gas from exiting the contact valve housing 106. If the movable portion 28 of the nose assembly 22 is able to move greater than the predetermined distance PD, the body portion 110 of the contact valve 68 will move such that the seal 122 will block or move past the second openings 118*b*, which prevents the pressurized gas from entering the second portion of the cavity 108*b*, as shown in FIGS. 4 and 5, thereby preventing the pressurized gas from being exhausted through the opening 131.

By containing the pressurized gas to the small volume 116 between the insert 114 and the contact valve housing 106, and to the first portion of the cavity 108*a*, as shown in FIG. 5, the pressure of the gas in the chamber 70 above the head valve 58 does not realize a pressure drop that is large enough to actuate the head valve 58. However, if the pressurized gas is able to pass by the seal 122 on the body portion 110 and exhaust to atmosphere by escaping through the opening 131 in the contact valve housing 106, the pressure drop that is created will cause the head valve 58 to actuate, thereby causing the driver 42 to move through a drive stroke and drive the leading fastener 32 into the workpiece WP.

The predetermined distance PD may be zero, but is preferably a discernible distance, such as up to about one-quarter (0.25) of an inch. In another embodiment, the predetermined distance PD is about 0.15 inches. This allows a tip 132 of the leading fastener 32 to be visible so that the leading fastener 32 may be used to identify the target position at which it should be driven, yet also allows the movable portion 28 of the nose assembly 22 to move far enough to substantially surround the circumference of the leading fastener 32 along its entire length as the leading fastener 32 is being driven by the driver 42. This arrangement may result in a more precise and stable drive because it allows the fastener that is being driven through the drive track to be guided all the way to the workpiece. Thus, the predetermined distance PD may be defined as the distance between a distal end 134 of the movable portion 28 of the nose assembly 22 and the tip 132 of the leading fastener 32 when the leading fastener 32 is located within the drive track 24.

Of course, the illustrated embodiment of the contact valve 68 is not intended to be limiting in any way. Other arrangements that prevent the pressurized gas from the chamber 70 above the head valve 58 to exhaust through the contact valve 68 when the device 10 is not located near the workpiece WP are contemplated and are considered to be within the scope of the present invention.

Figure 13:
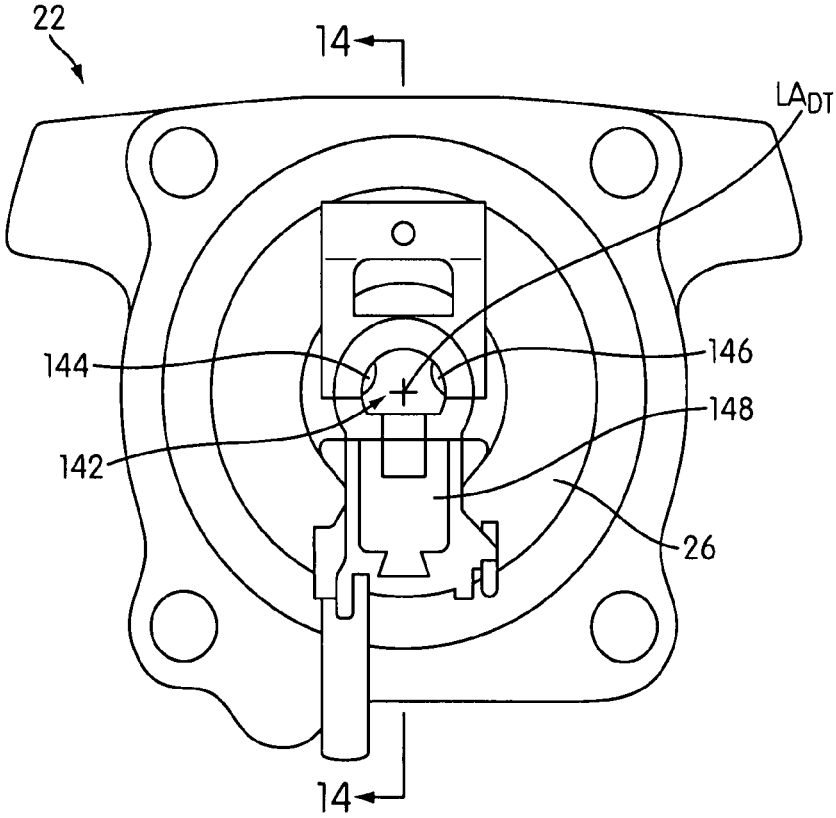
FIG. 13 is a bottom view of the fixed portion of the nose assembly of FIG. 10.
Figure 14:
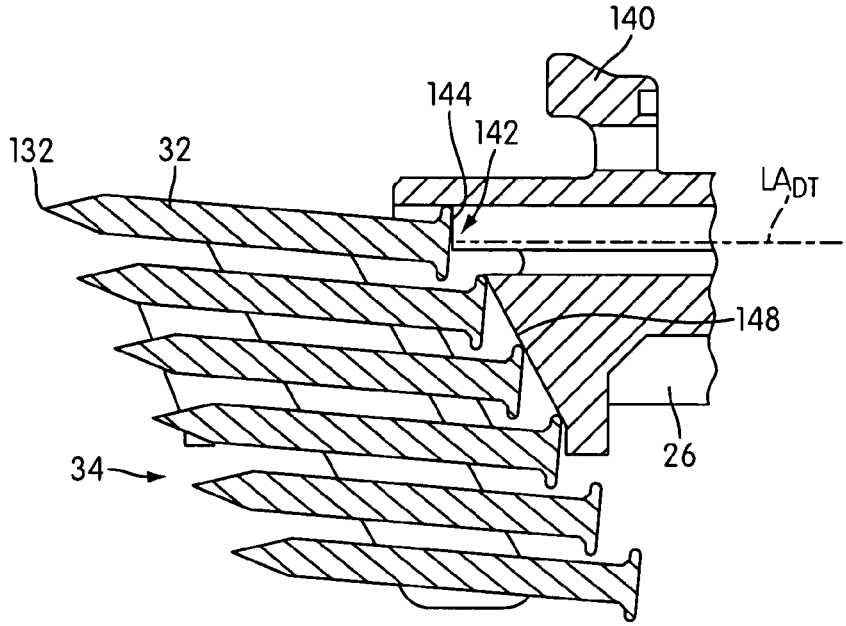
FIG. 14 is a cross-sectional view taken along line XIV-XIV in FIG. 13, with fasteners loaded in the device.

As shown in FIGS. 13 and 14, the nose assembly 22 may include a stop 142. The stop 142 is configured to prevent the leading fastener 32 from moving towards the housing 12 and away from the workpiece WP. As shown in FIGS. 13 and 14, the stop 142 is part of the fixed portion 26 and includes two surfaces 144, 146 that are positioned on opposite sides of the longitudinal axis of the drive track $LA_{DT}$. As shown in FIG. 13, the stop 142 is constructed and arranged to take up as little space of the drive track 24 as possible, yet still provide adequate support for the leading fastener 32. This way, when the leading fastener 32 is pressed against the workpiece WP, it will not have the tendency to either break away from the supply of fasteners 34 or change its position relative to the other fasteners within the supply (e.g., twist or rotate). A second stop 148 may also be provided on the fixed portion 26 to prevent the movement of the supply of fasteners 34 towards the housing 12. As shown in FIG. 13, the second stop 148 provides a ramped surface that engages the heads of the three fasteners that are located adjacent the leading fastener 32.

Figure 8:
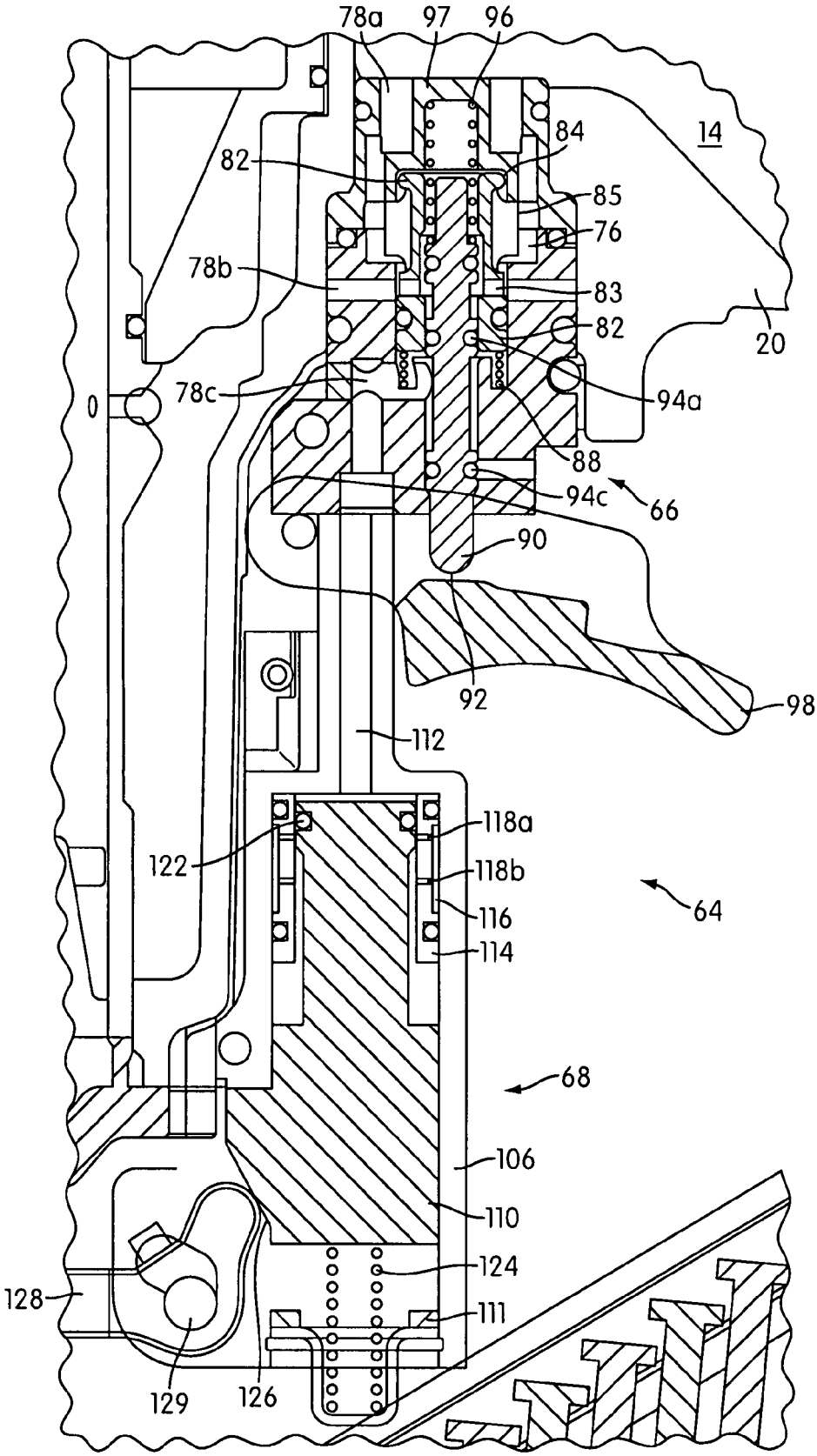
FIG. 8 is a detailed view of the actuator with no pressurized gas contained within the device.

Returning to the actuator 64, as would be appreciated by one of skill in the art, the design of the trigger valve 66 and contact valve 68 provide an additional safety feature in the event the valve stem 90 is depressed while the reservoir 14 becomes pressurized. FIG. 8 shows the actuator 64 when the device 10 is at rest and no pressurized gas is in the device 10. As illustrated, the spring 124 of the contact valve 68 biases the body portion 110 towards the passageway 112, the spring 88 biases the poppet 82 to its first position, and the spring 96 biases the valve stem 90 to its outward position.

During normal operation, the valve stem 90 remains in its outward position when the pressurized gas enters the reservoir 14, as shown in FIG. 3. When the pressurized gas that is in the reservoir 14 flows through the first passageway 78*a*, it initially flows through the passageway 83 in the poppet 82, flows through the interior of the poppet 82, and then enters the first portion 84 of the cavity 76 that is located between the cap portion 97 and the poppet 82. The pressurized gas is then able to act on the poppet 82 against the bias of the spring 88 so as to move the poppet 82 into the second position, as shown in FIG. 3. At the same time, the pressurized gas is also able to flow through the second passageway 78*b* and the passageway 71 to the chamber 70 above the head valve 58. The pressurized gas is not able to flow to the contact valve 68 because of the first seal 94*a* between the valve stem 90 and the poppet 82, and because of the seal 87 between the poppet 82 and the body 74.

When the valve stem 90 is depressed before the pressurized gas first fills the reservoir 14, and the moveable portion 28 of the nose assembly 22 is more than the predetermined distance PD from the workpiece WP, the condition shown in FIG. 9 may be realized. Because the valve stem 90 is already depressed against the bias of the spring 96, the seal 94*b* seals off the interior of the poppet 82 from the first portion 84 of the cavity 76. This prevents the poppet 82 from being moved against the bias of the spring 88, and allows the pressurized gas to flow directly from the first passageway 78*a* to the second passageway 78*b* and to the chamber 70 above the head valve 58. This relative positioning of the valve stem 90 and the poppet 82 also prevents the first seal 94*a* from creating a seal between the valve stem 90 and the poppet 82 and allows the pressurized gas to enter the third passageway 78*c* and the passageway 112 in the contact valve 68. If the distal end 134 of the movable portion 28 of the nose assembly 22 is located greater than the predetermined distance PD from the workpiece WP, the body portion 110 of the contact valve 68 is able to move so that the seal 122 prevents the pressurized gas from exhausting to atmosphere, as described above, which prevents actuation of the head valve 58.

Operation of the fastener driving device 10 of the present invention will now be described. As shown in FIG. 8, when the device 10 is at rest and no pressurized gas is contained within the reservoir 14, the spring 88 biases the poppet 82 of the trigger valve 66 in the first position, the spring 96 biases the valve stem 90 in the first position, and the spring 124 biases the body portion 110 of the contact valve 68 in the first position. As shown in FIG. 2, when pressurized gas is received by the reservoir 14, the gas is able to flow through the passageways 78*a*, 78*b* in the trigger valve 66 and enter the chamber 70 above the head valve 58. With the reservoir 14 now charged with pressurized gas, the device 10 is ready to be used to drive the leading fastener 32 into the workpiece WP.

As shown in FIG. 4, if the distal end 134 of the movable portion 28 of the nose assembly 22 is not positioned within the predetermined distance PD from the workpiece, and the trigger 98 is depressed against the valve stem 90, the valve stem 90 will move to the second position, thereby opening the passageway 78*c* between the chamber 70 above the head valve 58 and the contact valve 68. The pressurized gas will flow through the trigger valve 66 to the contact valve 68, and push the body portion 110 against the bias of the spring 124, thereby causing the cam follower 128 to pivot about its axis 129. Without the movement of the movable portion 28 of the nose assembly 22 being restricted, the cam follower 128 will continue to push the slider 136 and the movable portion 28 of the nose assembly 28 away from the housing 12. Because there is nothing to restrict movement of the body portion 110 (until it abuts the stop 111), as shown in greater detail in FIG. 5, the seal 122 is now located below the second openings 118*b*, so the pressurized gas may not be exhausted to atmosphere through the opening 131 in the contact valve housing 106. Any pressure drop that is realized with the movement of the body portion 110 is not enough to cause the head valve 58 to actuate and move to its open position. As a result, the driver 42 will not drive the leading fastener 32.

If the distal end 134 of the movable portion 28 of the nose assembly 22 is positioned within the predetermined distance from the workpiece and the trigger 98 is depressed against the valve stem 90, the valve stem 90 will move to the second position, thereby opening the passageway 78*c* between the chamber 70 above the head valve 58 and the contact valve 68. The pressurized gas will flow through the trigger valve 66 to the contact valve 68, and push the body portion 110 against the bias of the spring 124, thereby causing the cam follower 128 to pivot about its axis 129. However, because the movement of the movable portion 28 of the nose assembly 22 will be limited to the predetermined distance PD, the cam follower 128 will act as a brake to the body portion 110 of the contact valve 68. As shown in greater detail in FIG. 7, the seal 122 is now located in between the first and second openings 118*a*, 118*b*. This allows the pressurized gas to bypass the seal 122 and exhaust to atmosphere through the opening 131 in the contact valve housing 106 and cause a large enough pressure drop within the chamber 70 above the head valve 58 to cause the head valve 58 to actuate.

Once the head valve 58 has been actuated and has moved to the open position, the pressurized gas from the reservoir 14 enters the cylinder 40 above the driver 42 and pushes the driver 42 toward the drive track 24. The gas that is located within the cylinder 40 below the piston 52 is pushed into the plenum 46 through the holes 44 and the opening 50. A bumper 100 is disposed at one end of the cylinder 40. The bumper 100 has a central opening 102 for receiving the drive rod 54 as the driver 42 is accelerated toward the drive track 24 during the drive stroke, and is configured to soften the impact of the piston 52 at the end of the drive stroke. Thus, movement of the head valve 58 to the open position allows pressurized gas from the reservoir 14 to enter a space 104 above the piston 52. Due to the pressure differential between the volume above the piston 52 and the volume below the piston 52, the piston 52 accelerates towards the bumper 100, thereby causing the drive rod 54 to drive the leading fastener 32 out of the drive track 24 and into the workpiece WP.

After the trigger 98 is released, the pressurized gas from the reservoir 14 is able to flow through the trigger valve 90 and the passageway 71 to the chamber 70 above the head valve 58, and the head valve 58 returns to its first position under the influence of the spring 60 and the pressurized gas within the chamber 70, thereby resealing the cylinder 40 from the reservoir 14. The pressurized gas above the driver 42 within the cylinder 40 is exhausted to atmosphere through the opening 62 in the head valve 58 and through at least one opening 103 in the cap 18.

An exhaust deflector 105 may be rotatably mounted connected to the cap 18 so that the direction of the exhaust stream may be chosen by the user. It is also contemplated that the exhaust deflector 105 may be fixedly connected to the cap 18 such that the direction of the exhaust stream is fixed. Once the pressurized gas above the driver 42 begins to exhaust, a pressure differential between the plenum 46 and the volume 104 above the piston 52 within the cylinder 40 causes the piston 52 to move towards the cap 18, thereby moving the driver 42 through its return stroke. The device 10 is now ready to be used to drive the new leading fastener 34 that has been pushed into the drive track 34 by the pusher 37.

As would be appreciated by one of ordinary skill in the art, the device 10 of the present invention is suitable for many applications, as the ability to use the leading fastener to locate the precise location of the driven fastener may be desirable in application other than connecting metal connectors to workpieces. Moreover, by specifically constructing the magazine assembly 30 to accommodate one size of fastener, the predetermined distance and, hence, the location of the openings 118*a*, 118*b* in the insert 114 of the contact valve 68 may be determined. Also, the overall size of the tool may be minimized because the size of the engine 38, reservoir 14, and magazine assembly 30 may be optimized. Of course, in general, the device 10 is scalable, and may be constructed and arranged to be smaller or larger, depending on its intended application. The illustrated embodiments are not intended to be limiting in any way.

It is contemplated that the above-described embodiments may be used with a contact arm that is separate from the nose assembly. That is, although the embodiments described herein include a movable portion of the nose assembly that interacts with the contact valve, it is contemplated that the device may be configured with a contact arm that may be considered to be separate from the nose assembly and still be within the scope of the invention.

The foregoing illustrated embodiments have been provided solely for illustrating the structural and functional principles of the present invention and are not intended to be limiting. To the contrary, the present invention is intended to encompass all modifications, alterations, substitutions, and equivalents within the spirit and scope of the following claims.

All of the various features and mechanisms described with respect to the specific embodiments may be interchanged with the various embodiments described, or may be used with other variations or embodiments.

What is claimed is:

1. A fastener driving device comprising:

a housing having a reservoir therein, the reservoir being configured to receive a pressurized gas;

a nose assembly carried by the housing, said nose assembly having a fastener drive track, at least a portion of the fastener drive track being defined by a movable portion of the nose assembly;

a magazine assembly constructed and arranged to feed successive leading fasteners from a supply of fasteners contained therein into said drive track;

a fastener driver movably mounted in said housing and configured to enter said drive track and drive the successive leading fasteners into a workpiece;

a head valve constructed and arranged to be actuated so as to allow the pressurized gas to move said fastener driver through an operating cycle, the cycle including a drive stroke wherein the leading fastener is driven into the workpiece, and a return stroke; and an actuator constructed and arranged to actuate said head valve, said actuator comprising a trigger valve constructed and arranged to allow passage of the pressurized gas from the reservoir to a chamber above the head valve; and a contact valve operatively connected to the movable portion of the nose assembly and to the trigger valve via a passageway, the contact valve comprising a body portion constructed and arranged to move at least between a first position and a second position, wherein when the trigger valve is actuated, the pressurized gas flows through the trigger valve to the contact valve via the passageway, and wherein the contact valve is constructed and arranged to 1) contain the pressurized gas if the body portion is in the first position and the movable portion of the nose assembly is beyond a predetermined distance relative to a fixed portion of the nose assembly, and 2) exhaust the pressurized gas from the chamber above the head valve to atmosphere if the body portion is in the second position and the movable portion of the nose assembly is not beyond the predetermined distance, thereby causing actuation of the head valve.

2. A fastener driving device according to claim 1, wherein the magazine is configured to position the leading fastener in the drive track such that a tip of the leading fastener extends outward and away from the movable nose portion before the leading fastener is driven by the fastener driver.

3. A fastener driving device according to claim 2, wherein the fasteners have a length of about 1.5 inches.

4. A fastener driving device according to claim 3, wherein the fasteners are configured to attach a metal connector to the workpiece.

5. A fastener driving device according to claim 1, wherein the body portion has a cam surface, and wherein the body portion is operatively connected to the movable portion of the nose assembly via a cam follower, the cam follower having a surface at one end that contacts the cam surface of the body portion such that movement of the body portion causes the cam follower to rotate and effect movement of the movable portion of the nose assembly.

6. A fastener driving device according to claim 5, wherein the contact valve further comprises:

a contact valve housing configured to receive the body portion, the contact valve housing having an opening to the atmosphere; and a seal disposed around the body portion, wherein an amount of movement of the body portion and the seal within the contact valve determines whether the pressurized gas bypasses the seal and exits the opening to the atmosphere, the amount of movement being correlated to the predetermined distance and the cam surface.

7. A fastener driving device according to claim 1, wherein the predetermined distance is about 0.25 inch or less.

8. A fastener driving device according to claim 7, wherein the predetermined distance is about 0.15 inch or less.

9. A fastener driving device according to claim 1, wherein the drive track is entirely defined by the movable portion of the nose assembly.

10. A fastener driving device according to claim 1, wherein the nose assembly further includes a stop for preventing the leading fastener from moving toward the housing.

11. A fastener driving device comprising:

a housing having a reservoir therein, the reservoir being configured to receive a pressurized gas;

a nose assembly carried by the housing, said nose assembly having a fastener drive track, at least a portion of the fastener drive track being defined by a movable portion of the nose assembly;

a magazine assembly constructed and arranged to feed only one length of successive leading fasteners from a supply of fasteners contained therein along into said drive track;

a fastener driver movably mounted in said housing and configured to enter said drive track and drive the successive leading fasteners into a workpiece; and a head valve constructed and arranged to be actuated so as to allow the pressurized gas to move said fastener driver through successive operating cycles, each cycle including a drive stroke wherein the leading fastener is driven into the workpiece, and a return stroke; and an actuator constructed and arranged to actuate said head valve, wherein the fasteners have a length of about 1.5 inches and are configured to attach a metal connector to the workpiece, and wherein the magazine is configured to position the leading fastener in the drive track such that a tip of the leading fastener extends outward and away from the movable portion of the nose assembly before the leading fastener is driven by the fastener driver.

12. A fastener driving device according to claim 11, wherein the actuator comprises:

a trigger valve constructed and arranged to allow passage of the pressurized gas from the reservoir to a chamber above the head valve; and a contact valve operatively connected to the trigger valve via a passageway, the contact valve comprising a body portion constructed and arranged to move at least between a first position and a second position, wherein when the trigger valve is actuated, the pressurized gas flows through the trigger valve to the contact valve via the passageway, and wherein the contact valve is constructed and arranged to 1) contain the pressurized gas if the body portion is in the first position and the movable portion of the nose assembly is beyond a predetermined distance relative to a fixed portion of the nose assembly, and 2) exhaust the pressurized gas from the chamber above the head valve to atmosphere if the body portion is in the second position and the movable portion of the nose assembly is not beyond the predetermined distance, thereby causing actuation of the head valve.

13. A fastener driving device according to claim 12, wherein the body portion has a cam surface, and the body portion is operatively connected to the movable portion of the nose assembly via a cam follower, the cam follower having a surface at one end that contacts the cam surface of the body portion such that movement of the body portion causes the cam follower to rotate and effect movement of the movable portion of the nose assembly.

14. A fastener driving device according to claim 13, wherein the contact valve further comprises:

a contact valve housing configured to receive the body portion, the contact valve housing having an opening to the atmosphere; and a seal disposed around the body portion, wherein an amount of movement of the body portion and the seal within the contact valve determines whether the pressurized gas bypasses the seal and exits the opening to the atmosphere, the amount of movement being correlated to the predetermined distance.

15. A fastener driving device according to claim 12, wherein the predetermined distance is about 0.25 inch or less.

16. A fastener driving device according to claim 15, wherein the predetermined distance is about 0.15 inch or less.

17. A fastener driving device according to claim 11, wherein the nose assembly further includes a stop for preventing the leading fastener from moving toward the housing.

18. An actuator for a fastener driving device, the actuator comprising:

a trigger valve; and a contact valve operatively connected to the trigger valve via a passageway, the contact valve comprising a body portion constructed and arranged to move at least between a first position and a second position.

the trigger valve being configured to 1) communicate a pressurized gas from a reservoir associated with the fastener driving device to a chamber above a head valve disposed within the fastener driving device, and 2) communicate the pressurized gas from the head valve to the contact valve via the passageway, the contact valve being configured to 1) contain the pressurized gas from the chamber if the body portion is in the first position and the fastener driving device is not located within a predetermined distance of a workpiece, and 2) communicate the pressurized gas from the chamber to atmosphere if the body portion is in the second position and the fastener driving device is located within the predetermined distance, thereby causing actuation of the head valve.

19. An actuator according to claim 18, wherein the contact valve further comprises:

a contact valve housing configured to receive the body portion, the contact valve housing having an opening to the atmosphere; and a seal disposed around the body portion, wherein an amount of movement of the body portion and the seal within the contact valve housing determines whether the pressurized gas bypasses the seal and exits the opening to the atmosphere, the amount of movement being correlated to the predetermined distance.

20. An actuator according to claim 18, wherein the predetermined distance is about 0.25 inch or less.

21. An actuator according to claim 20, wherein the predetermined distance is about 0.15 inch or less.

* * * * *

UNITED STATES PATENT AND TRADEMARK OFFICE

CERTIFICATE OF CORRECTION

PATENT NO. : 7,677,426 B2
APPLICATION NO. : 11/228457
DATED : March 16, 2010
INVENTOR(S) : Adam Tillinghast et al.

It is certified that error appears in the above-identified patent and that said Letters Patent is hereby corrected as shown below:

On title page, item (56) References Cited

Please add the following U.S. Patent Document reference as cited by the Examiner in the Non-Final Office Action dated October 9, 2007

**--3,677,456 A * 7/1972 Ramspeck et al.--**

Signed and Sealed this

Thirtieth Day of November, 2010

David J. Kappos

David J. Kappos
*Director of the United States Patent and Trademark Office*